US008530745B2

(12) United States Patent
Eshima

(10) Patent No.: US 8,530,745 B2
(45) Date of Patent: Sep. 10, 2013

(54) CABLE INCLUDING ELEMENTAL WIRES WITH DIFFERENT ANGLES

(75) Inventor: Hirotaka Eshima, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 533 days.

(21) Appl. No.: 12/588,992

(22) Filed: Nov. 4, 2009

(65) Prior Publication Data

US 2010/0218970 A1 Sep. 2, 2010

(30) Foreign Application Priority Data

Feb. 27, 2009 (JP) ..... 2009-045228
Jul. 24, 2009 (JP) ..... 2009-172751

(51) Int. Cl.
*H01B 7/18* (2006.01)
*H01B 7/22* (2006.01)

(52) U.S. Cl.
USPC ..... 174/108

(58) Field of Classification Search
USPC ..... 174/108
See application file for complete search history.

(56) References Cited

U.S. PATENT DOCUMENTS 311,174 A * 1/1885 Clark ..... 174/105 R
2,037,543 A * 4/1936 Seaberg ..... 174/107
2,041,842 A * 5/1936 Layton ..... 174/106 R
2,087,303 A * 7/1937 Rosch et al. ..... 174/122 C
2,320,201 A * 5/1943 Szilard ..... 174/121 A
2,754,351 A * 7/1956 Horn ..... 174/105 R
2,886,631 A * 5/1959 Muller ..... 174/108
3,429,984 A * 2/1969 Alexander ..... 174/115
3,541,221 A * 11/1970 Moisson-Franckhauser et al. ..... 174/13
3,885,085 A * 5/1975 Bahder et al. ..... 174/36
4,131,759 A * 12/1978 Felkel ..... 174/107
4,250,351 A 2/1981 Bridges
4,408,089 A * 10/1983 Nixon ..... 174/34
4,505,541 A * 3/1985 Considine et al. ..... 385/107
4,626,810 A * 12/1986 Nixon ..... 333/243
4,638,114 A * 1/1987 Mori ..... 174/36

(Continued)

FOREIGN PATENT DOCUMENTS

JP 56-28411 A 3/1981
JP 6-349345 12/1994

(Continued)

OTHER PUBLICATIONS

Japanese Office Action dated May 21, 2013 with English translation thereof.

*Primary Examiner* — Timothy Thompson
*Assistant Examiner* — Nathan Milakovich
(74) *Attorney, Agent, or Firm* — McGinn Intellectual Property Law Group, PLLC

(57) ABSTRACT

A cable includes an insulated electric wire, a lateral winding layer formed by spirally winding an elemental wire having conductivity on a periphery of the insulated electric wire, a reversal lateral winding layer formed by spirally winding an elemental wire having conductivity in a direction intersecting with the winding direction of the lateral winding layer, a buffer layer formed between the lateral winding layer and the reversal lateral winding layer, and a sheath formed on a periphery of the reversal lateral winding layer. Each of a winding angle θ1 of the elemental wire forming the lateral winding layer and a winding angle θ2 of the elemental wire forming the reversal lateral winding layer is an acute angle, and an absolute value of difference between the winding angle θ1 and the winding angle θ2 is not more than 20 degrees.

9 Claims, 6 Drawing Sheets

(56) References Cited

U.S. PATENT DOCUMENTS

| | | | | |
|---|---|---|---|---|
| 4,738,734 | A * | 4/1988 | Ziemek | 156/53 |
| 4,746,766 | A * | 5/1988 | Soulard | 174/36 |
| 5,304,739 | A * | 4/1994 | Klug et al. | 174/102 R |
| 5,463,188 | A * | 10/1995 | Nohmi et al. | 174/108 |
| 5,739,471 | A * | 4/1998 | Burisch | 174/102 R |
| 5,930,100 | A * | 7/1999 | Gasque, Jr. | 361/117 |
| 6,233,384 | B1 * | 5/2001 | Sowell et al. | 385/107 |
| 7,323,640 | B2 * | 1/2008 | Takahashi et al. | 174/106 R |
| 2006/0048966 | A1 * | 3/2006 | Takahashi et al. | 174/108 |
| 2006/0175078 | A1 * | 8/2006 | Yumura et al. | 174/125.1 |
| 2011/0139485 | A1 * | 6/2011 | Matsuda et al. | 174/102 R |
| 2011/0253415 | A1 * | 10/2011 | Muschiatti et al. | 174/107 |

FOREIGN PATENT DOCUMENTS

| | | | |
|---|---|---|---|
| JP | 2000123648 | A * | 4/2000 |
| JP | 2000-311520 | A | 11/2000 |
| JP | 2007188782 | A * | 7/2007 |
| JP | 2007-311043 | | 11/2007 |
| JP | 2007-311043 | A | 11/2007 |

* cited by examiner

20
θ1
A
AXIAL DIRECTION

40
θ2
A

CABLE INCLUDING ELEMENTAL WIRES WITH DIFFERENT ANGLES

The present application is based on Japanese patent application Nos.2009-045228 and 2009-172751 filed Feb.27, 2009 and Jul. 24, 2009, respectively, the entire contents of which are incorporated herein by reference.

BACKGROUND OF THE INVENTION

1. Field of the Invention

This invention relates to a cable including insulated electric wires. In particular, this invention relates to a cable that is used as a shield cable.

2. Description of the Related Art

Recently, following an increase in the number of motor cars equipped with electric components, electric cables including power wires and signal wires are used in an environment where an influence of vibration and bend is significant. Conventionally, an electric cable is known, the cable including a plurality of electric wires, a first lateral winding shield layer formed by laterally winding a metal elemental wire on each of peripheries of the plural electric wires, a buffer layer formed on a periphery of the first lateral winding shield layer, a second lateral winding shield layer formed by laterally winding a metal elemental wire on a periphery of the buffer layer in an opposite direction to the first lateral winding shield layer, and a sheath covering the second lateral winding shield layer. This technique is disclosed in, for example, JP-A-2007-311043.

The electric cable disclosed in JP-A-2007-311043 includes the buffer layer between the first lateral winding shield layer and the second lateral winding shield layer, so that a bending life of the electric shield layer can be prolonged, and an electric cable having excellent flexibility can be provided.

However, although the electric cable disclosed in JP-A-2007-311043 can prolong the bending life of the electric shield layer, it is still required for an electric cable used in an environment where an influence of vibration and bend is significant that bending durability and shielding performance are further enhanced.

SUMMARY OF THE INVENTION

Therefore, it is an object of the invention to solve the above-mentioned problem and provide a cable that has excellent bending durability and shielding characteristics.

(1) According to one embodiment of the invention, a cable includes:

an insulated electric wire;

a lateral winding layer formed by spirally winding an elemental wire having conductivity on a periphery of the insulated electric wire;

a buffer layer formed on the lateral winding layer;

a reversal lateral winding layer formed by spirally winding an elemental wire having conductivity in a direction intersecting with the winding direction of the lateral winding layer;

a buffer layer formed between the lateral winding layer and the reversal lateral winding layer; and a sheath formed on a periphery of the reversal lateral winding layer, wherein a winding angle θ1 of the elemental wire forming the lateral winding layer and a winding angle θ2 of the elemental wire forming the reversal lateral winding layer are each an acute angle, and an absolute value of difference between the winding angle θ1 and the winding angle θ2 is not more than 20 degrees.

In the above embodiment (1), the following modifications and changes can be made.

(i) The winding angle θ1 or the winding angle θ2 is not less than 40 degrees.

(ii) The cable further comprises a second buffer layer formed between the reversal lateral winding layer and the sheath.

(iii) The cable further comprises a reinforcing braided layer formed by alternately weaving a plurality of fibers together.

(iv) The buffer layer and the second buffer layer comprise a resin tape, a paper tape or a resin layer formed by an extrusion coating.

(v) At least one of the buffer layer and the second buffer layer comprises a laminated structure that includes at least one selected from the group consisting of the resin tape, the paper tape or the resin layer formed by an extrusion coating.

Points of the Invention

According to one embodiment of the invention, a cable includes a lateral winding layer formed by laterally winding elemental wires having conductivity, so that friction between the elemental wires can be reduced as compared to using a braided layer formed by braiding the elemental wires having conductivity. In addition, a buffer layer is formed between the lateral winding layer and a reversal lateral winding layer, so that even if the cable is bent, friction between the lateral winding layer and the reversal lateral winding layer can be prevented. Thus, the cable can have excellent flexibility and bending durability.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

First Embodiment

Figure 1B:
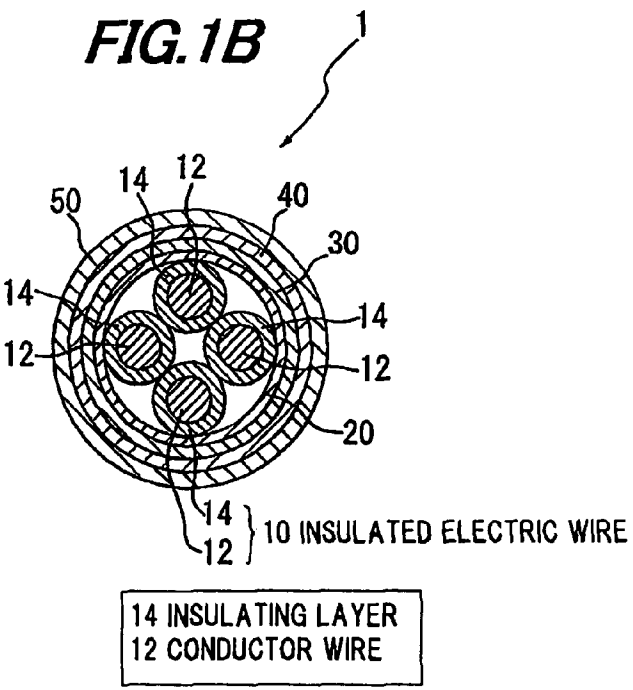
FIG. 1B is a cross-sectional view of FIG. 1A.

The preferred embodiments according to the invention will be explained below referring to the drawings.

Figure 1A:
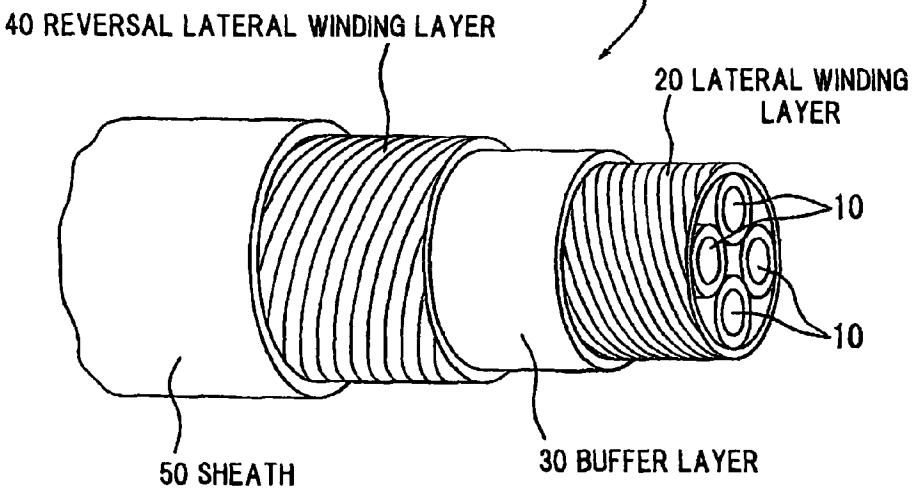
FIG. 1A is a perspective view schematically showing a structure of a cable according to a first embodiment of the invention.

FIG. 1A is a perspective view schematically showing a structure of a cable according to a first embodiment of the invention, and FIG. 1B is a cross-sectional view of FIG. 1A.

Outline of Composition of Cable 1

Referring to FIGS. 1A and 1B, the cable 1 according to the first embodiment includes four insulated electric wires 10, a lateral winding layer 20 formed by spirally winding an elemental wire having conductivity on peripheries of the insulated electric wires 10, a buffer layer 30 formed on the lateral winding layer 20, a reversal lateral winding layer 40 formed by spirally winding an elemental wire having conductivity on the buffer layer 30 in a direction intersecting with the winding direction of the lateral winding layer 20 and a sheath 50 formed on a periphery of the reversal lateral winding layer 40. The buffer layer 30 used for the cable 1 according to the first embodiment is formed at a location that it contacts a periphery of the lateral winding layer 20 and simultaneously contacts an inner periphery of the reversal lateral winding layer 40. Namely, the buffer layer 30 contacts both of the lateral winding layer 20 and the reversal lateral winding layer 40.

Insulated Electric Wire 10

The insulated electric wire 10 includes a conductor wire 12 and an insulating layer 14 covering a periphery of the conductor wire 12. The conductor wire 12 is formed of a single metal elemental wire or an composite twisted wire obtained by twisting a plurality of metal elemental wires. As the metal elemental wire, for example, an annealed copper wire, a silver-plated annealed copper wire, a tin-plated annealed copper wire, and a tin-plated copper alloy wire can be used. And, as the insulating layer 14, a resin material having insulation properties can be used. For example, the insulating layer 14 can be formed of polyethylene, polypropylene, fluororesin or the like.

In case that the cable 1 has a plurality of the insulated electric wires 10, the insulated electric wires 10 have a bundled shape formed by being twisted together. And, a hold winding for keeping the bundled shape of the insulated electric wires 10 can be formed on peripheries of the plural insulated electric wires 10 being bundled. As the hold winding, for example, a paper tape or the like can be used. Further, an interposition formed of fiber, resin or the like can be filled between the hold winding formed of the paper tape or the like and the insulated electric wires 10. The interposition is filled between the hold winding and the insulated electric wires 10, so that a cross-section surface of the cable 1 can be easily maintained to be circular.

Further, the number of the insulated electric wires 10 is set to four in the first embodiment, but it can be set to one (i.e., a single wire) or a plurality of not less than two according to a use mode of the cable 1. And, a diameter of the insulated electric wire 10, the twisted structure of the metal elemental wires and the like can be changed according to the use mode of the cable 1.

Lateral Winding Layer 20

The lateral winding layer 20 is formed by spirally winding an elemental wire having conductivity on peripheries of the insulated electric wires 10. Namely, the lateral winding layer 20 is formed by laterally winding a plurality of elemental wires having conductivity in a spiral shape, at a predetermined pitch. For example, the lateral winding layer 20 is formed by laterally winding from one end to the other end of the insulated electric wire 10 in a right-handed or a left-handed helical shape. And, the elemental wire having conductivity is formed of, for example, an annealed copper wire, a tin-plated annealed copper wire, and a copper alloy wire. The lateral winding layer 20 functions as an electric shielding layer that is capable of preventing an electromagnetic wave noise from being mixed from the outside of the cable 1 into the insulated electric wires 10, and simultaneously preventing an electromagnetic wave noise from being emitted from the insulated electric wires 10 to the outside of the cable 1.

Buffer Layer 30

The buffer layer 30 is formed between the lateral winding layer 20 and the reversal lateral winding layer 40. The buffer layer 30 used for the first embodiment covers a periphery of the lateral winding layer 20. The buffer layer 30 is formed of a tape or a resin layer formed on the periphery of the lateral winding layer 20 by an extrusion covering. As the tape, a resin tape such as polyethylene terephthalate (PET) or a paper tape can be used. And, the resin layer can be formed of polyvinyl chloride (PVC), polyethylene, fluororesin or the like. And, the resin layer can be also formed of a resin having insulation properties or a resin having conductivity. If the resin layer is formed of the resin having conductivity, impedance of all the buffer layer 30 can be reduced, so that a noise screening effect, namely, a shielding effect of the cable 1 according to the embodiment can be enhanced. However, even if the resin layer is formed of the resin having insulation properties, the shielding effect of the cable 1 according to the embodiment can be maintained to be comparable to, for example, a conventional copper braided shield cable. Further, the buffer layer 30 can be formed so as to have a laminated structure of a plurality of tapes, a laminated structure of a plurality of resin layers, or a laminated structure of the tape and the resin layer.

Reversal Lateral Winding Layer 40

The reversal lateral winding layer 40 is formed by spirally winding an elemental wire having conductivity in a direction intersecting with the winding direction of the lateral winding layer 20. Particularly, the reversal lateral winding layer 40 is formed by laterally winding the plural elemental wires having conductivity in a direction intersecting with the winding direction of the elemental wires constituting the lateral winding layer 20 to the insulated electric wires 10 in a spiral shape, at a predetermined pitch. Namely, the reversal lateral winding layer 40 is formed of the elemental wires that are wound on a periphery of the buffer layer 30 in a winding direction opposite to the winding direction of the elemental wires constituting the lateral winding layer 20 to the insulated electric wires 10.

For example, if the lateral winding layer 20 is formed by that the elemental wires are laterally wound right-handed from one end to the other end of the insulated electric wires 10, the reversal lateral winding layer 40 is formed by that the elemental wires are laterally wound left-handed from the one end to the other end. Similarly, if the lateral winding layer 20 is formed by that the elemental wires are laterally wound left-handed from one end to the other end of the insulated electric wires 10, the reversal lateral winding layer 40 is formed by that the elemental wires are laterally wound right-handed from the one end to the other end. Further, as the elemental wires constituting the reversal lateral winding layer 40, for example, an annealed copper wire, a tin-plated annealed copper wire, and a copper alloy wire can be used similarly to the elemental wires constituting the lateral winding layer 20. The reversal lateral winding layer 40 functions as an electric shielding layer, similarly to the lateral winding layer 20, that is capable of preventing an electromagnetic wave noise from being mixed from the outside of the cable 1 into the insulated electric wires 10, and simultaneously preventing an electromagnetic wave noise from being emitted from the insulated electric wires 10 to the outside of the cable 1.

Sheath 50

The sheath 50 is formed on a periphery of the reversal lateral winding layer 40. The sheath 50 can be formed of a rubber material such as ethylene-propylene-diene terpolymer rubber (EPDM) and a resin material such as polyurethane. And, the sheath 50 is formed to be almost circular in cross-section. Further, an arrangement, a shape, a diameter and the like of the insulated electric wires 10 can be determined in accordance with the intended use.

Detail of Winding Directions of Lateral Winding Layer 20 and Reversal Lateral Winding Layer 40

Figures 2A, 2B:
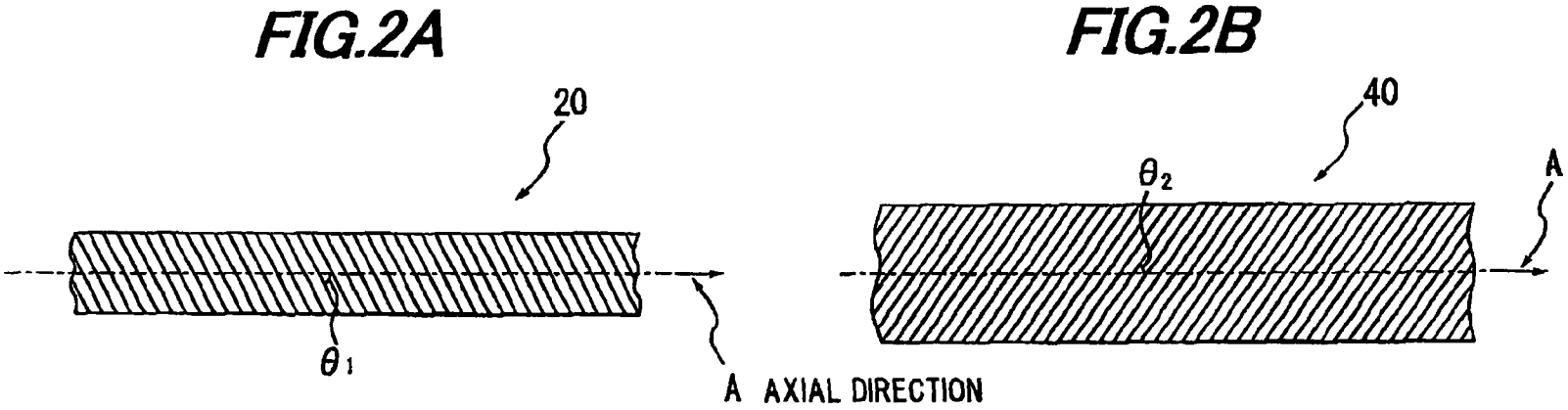
FIG. 2A is an explanatory view schematically showing a winding direction of a lateral winding layer used for the first embodiment of the invention.
FIG. 2B is an explanatory view schematically showing a winding direction of a reversal lateral winding layer used for the first embodiment of the invention.

FIG. 2A is an explanatory view schematically showing a winding direction of a lateral winding layer used for the first embodiment of the invention and FIG. 2B is an explanatory view schematically showing a winding direction of a reversal lateral winding layer used for the first embodiment of the invention.

The lateral winding layer 20 according to the embodiment is formed by that the elemental wires are inclined to an axial direction A (for example, a direction from one end to the other end of the insulated electric wires 10) of the insulated electric wires 10 by a predetermined winding angle θ1, and the elemental wires in the inclined state are spirally wound on peripheries of the insulated electric wires 10. In the embodiment, the predetermined winding angle θ1 means an angle of the elemental wire wound on the insulated electric wires 10, the angle being inclined to the axial direction A (a direction for which arrows are directed in FIG. 2A) of the insulated electric wires 10, and means an acute angle of angles which occur when the elemental wire and the axial direction A are intersected with each other. Namely, the winding angle θ1 is an angle of more than 0 degree and less than 90 degrees. In the embodiment, it is preferable that the winding angle θ1 is not less than 40 degrees.

The reversal lateral winding layer 40 according to the embodiment is formed by that the elemental wires are inclined to an axial direction A of the insulated electric wires 10 by a predetermined winding angle θ2, and the elemental wires in the inclined state are wound on peripheries of the buffer layer 30. A winding direction of the elemental wire wound on a periphery of the buffer layer 30 is a direction opposite to the winding direction of the elemental wires which constitute the lateral winding layer 20 and are wound on peripheries of the insulated electric wires 10. In the embodiment, the predetermined winding angle θ2 means an angle of the elemental wire wound on the buffer layer 30, the angle being inclined to the axial direction A of the insulated electric wires 10, and means an acute angle of angles which occur when the elemental wire and the axial direction A are intersected with each other. Namely, the winding angle θ2 is an angle of more than 0 degree and less than 90 degrees. In the embodiment, it is preferable that the winding angle θ2 is not less than 40 degrees.

Further, in the embodiment, the lateral winding layer 20 and the reversal lateral winding layer 40 are respectively formed so as to satisfy a range that an absolute value of difference between the winding angle θ1 of the elemental wires constituting the lateral winding layer 20 and the winding angle θ2 of the elemental wires constituting the reversal lateral winding layer 40 is not less than 0 degree and not more than 20 degrees (Namely, $0° \leqq |\theta 1 - \theta 2| \leqq 20°$).

Advantages of the First Embodiment

The cable 1 according to the first embodiment of the invention includes the lateral winding layer 20 formed by laterally winding the elemental wires having conductivity, so that friction between the elemental wires can be reduced in comparison with a case of using a braided layer formed by braiding the elemental wires having conductivity. And, the buffer layer 30 is formed between the lateral winding layer 20 and the reversal lateral winding layer 40, so that even if the cable 1 is bent, friction between the lateral winding layer 20 and the reversal lateral winding layer 40 can be prevented. Due to this, according to the cable 1 of the first embodiment, the cable 1 having excellent flexibility and bending durability can be provided.

In addition, according to the cable 1 of the first embodiment, the lateral winding layer 20 and the reversal lateral winding layer 40 can be prevented from contacting each other due to the existence of the buffer layer 30, so that even if the cable 1 is repeatedly bent, the lateral winding layer 20 and the reversal lateral winding layer 40 can be prevented from mutually being in friction. Consequently, friction and abrasion between the elemental wires constituting the lateral winding layer 20 and the elemental wires constituting the reversal lateral winding layer 40 can be reduced, as a result, the elemental wires of the lateral winding layer 20 and the reversal lateral winding layer 40 can be prevented from being broken. Due to this, bending durability of the cable 1 can be enhanced, and simultaneously, the elemental wires can be prevented from a disadvantage that broken elemental wires are thrust into the insulating layers 14 of the insulated electric wires 10 as a power wire and a signal wire and the thrust elemental wires pass through the insulating layer 14, so that the insulated electric wires 10 can be protected against short circuit.

In addition, the cable 1 according to the first embodiment has a structure that the winding direction of the elemental wires constituting the lateral winding layer 20 and the winding direction of the elemental wires constituting the reversal lateral winding layer 40 are formed so as to intersect with each other, and simultaneously, an absolute value of difference between the winding angle θ1 of the elemental wires constituting the lateral winding layer 20 and the winding angle θ2 of the elemental wires constituting the reversal lateral winding layer 40 is set to not less than 0 degree and not more than 20 degrees. Due to this, shielding characteristics can be enhanced, that an emission noise from the cable 1 can be reduced and simultaneously, a mixture of an electromagnetic wave noise from the outside of the cable 1 into the insulated electric wires 10 can be prevented.

Second Embodiment

Figure 3B:
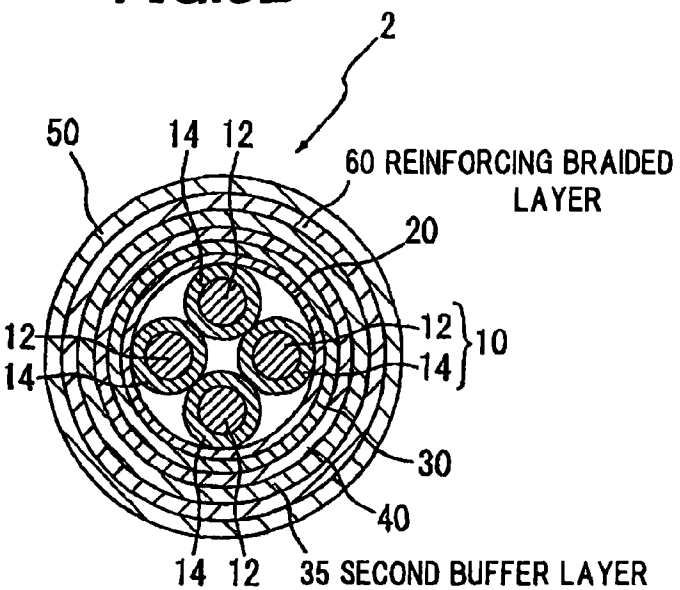
FIG. 3B is a cross-sectional view of FIG. 3A.
Figure 3A:
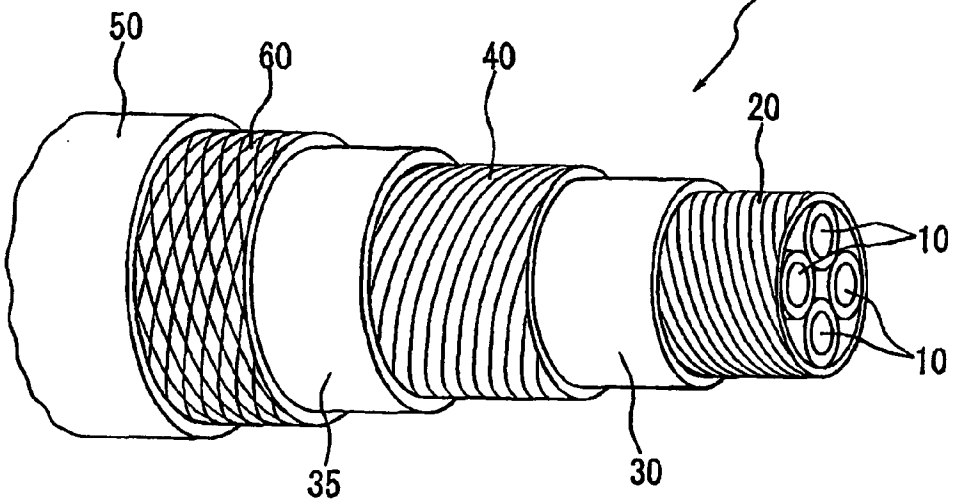
FIG. 3A is a perspective view schematically showing a structure of a cable according to a second embodiment of the invention.

FIG. 3A is a perspective view schematically showing a structure of a cable according to a second embodiment of the invention, and FIG. 3B is a cross-sectional view of FIG. 3A.

A cable 2 according to the second embodiment has almost the same composition as the cable 1 according to the first embodiment except for further including a second buffer layer 35 and a reinforcing braided layer 60. Consequently, detail explanations will be omitted except for difference points.

Outline of Composition of Cable 2

Referring to FIGS. 3A and 3B, the cable 2 according to the second embodiment includes four insulated electric wires 10, a lateral winding layer 20 formed by spirally winding an elemental wire having conductivity on peripheries of the insulated electric wires 10, a buffer layer 30 formed on the lateral winding layer 20, a reversal lateral winding layer 40 formed by spirally winding an elemental wire having conductivity on the buffer layer 30 in a direction intersecting with the winding direction of the lateral winding layer 20, the second buffer layer 35 formed on a periphery of the reversal lateral winding layer 40, the reinforcing braided layer 60 formed on a periphery of the second buffer layer 35 and a sheath 50 formed on a periphery of the reinforcing braided layer 60.

Second Buffer Layer 35

The second buffer layer 35 is formed between the reversal lateral winding layer 40 and the reinforcing braided layer 60. The second buffer layer 35 used for the second embodiment covers a periphery of the reversal lateral winding layer 40. The second buffer layer 35 can be formed by winding a tape on the periphery of the reversal lateral winding layer 40 similarly to the buffer layer 30. Also, the second buffer layer 35 can be formed by extruding and covering a resin material on the periphery of the reversal lateral winding layer 40. Namely, the second buffer layer 35 can be formed of the same material and by using the same method as the buffer layer 30.

Reinforcing Braided Layer 60

The reinforcing braided layer 60 is formed between the reversal lateral winding layer 40 and the sheath 50, and particularly, between the second buffer layer 35 and the sheath 50. The reinforcing braided layer 60 is formed by braiding a plurality of fibers alternately. As the fibers, for example, a polyvinyl alcohol fibrous material, a polyethylene terephthalate fibrous material, a polyethylene-2, 6-naphthalate fibrous material, or the like can be used.

Advantages of the Second Embodiment

The cable 2 according to the second embodiment includes the reinforcing braided layer 60 between the second buffer layer 35 and the sheath 50, so that tensile strength of the cable 2 can be enhanced. Consequently, the cable 2 can be used as, for example, a cable for electric power transmission to devices under springs of motor cars or a cable for signal transmission. If the cable 2 according to the second embodiment is used as the cable for electric power transmission to devices under springs of motor cars, the cable layout can be maintained even if foreign substance adheres to an outer surface of the cable.

In addition, the cable 2 according to the second embodiment includes the buffer layer 30 between the lateral winding layer 20 and the reversal lateral winding layer 40, and simultaneously, the second buffer layer 35 between the reversal lateral winding layer 40 and the reinforcing braided layer 60. Due to this, even if the cable 2 is bent, friction and abrasion between the reversal lateral winding layer 40 and the reinforcing braided layer 60 can be reduced by the second buffer layer 35. Consequently, the cable 2 according to the second embodiment can have extremely excellent flexibility.

Further, both of the cable 1 according to the first embodiment and the cable 2 according to the second embodiment can be used as an electric cable (for example, an electric wire or a signal wire) that is used for a movable device such as a robot, a motor car. Particularly, they can be used as a cable that is used in an environment where vibration, bend and the like are applied. For example, they can be used as an electric cable that constitutes a harness for an electric brake, a harness for an in-wheel motor of a motor car and the like.

EXAMPLES

Figure 4:
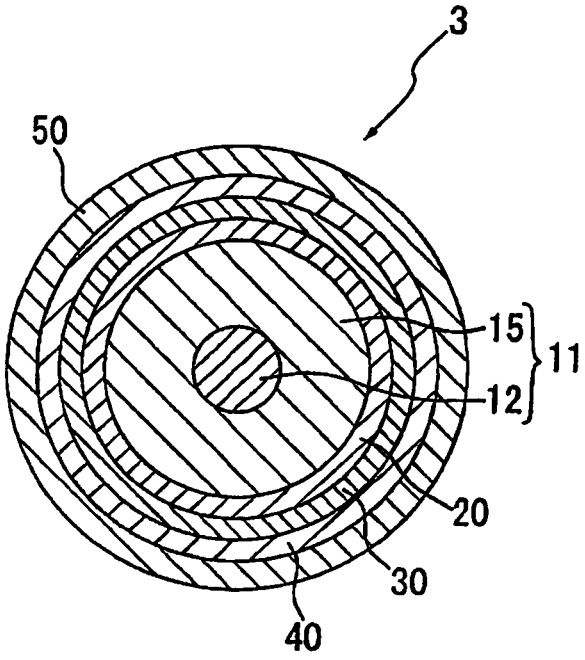
FIG. 4 is a cross-sectional view schematically showing a cable according to Example of the invention.

FIG. 4 is a cross-sectional view schematically showing a cable in Example of the invention.

A cable 3 according to Example includes a single insulated electric wire 11, a lateral winding layer 20 formed on a periphery of the insulated electric wire 11, a buffer layer 30 formed on a periphery of the lateral winding layer 20, a reversal lateral winding layer 40 formed on a periphery of the buffer layer 30 and a sheath 50 formed on a periphery of the reversal lateral winding layer 40. The insulated electric wire 11 has a conductor wire 12 and an insulating layer 15 which covers the conductor wire 12. Namely, the cable 3 according to Examples is a single core coaxial shielding cable.

Further, a cable according to Comparative Example was also fabricated together with the cable 3 according to Example. In Examples, the cables 3 were fabricated that have an absolute value of difference between the winding angle θ1 and the winding angle θ2 ranged from 5 degrees to 20 degrees. In Example 1, the absolute value of difference was 5 degrees, in Example 2, it was 15 degrees and in Example 3, it was 20 degrees. In Comparative Examples, the cables were fabricated that have the absolute value of difference between the winding angle θ1 and the winding angle θ2 of 25 degrees and 30 degrees. In Comparative Example 1, the absolute value of difference was 25 degrees, and in Comparative Example 2, it was 30 degrees.

As the conductor wire 12, a copper wire was used that has a diameter of 0.96 mm and conductor resistance of 33.3 mmΩ/m. Also, the insulating layer 15 was formed of polyethylene. And, a thickness of the insulating layer 15 was set to 1.02 mm. Consequently, a diameter of the insulated electric wire 11 was 3.0 mm. Also, the lateral winding layer 20 was formed by laterally winding elemental wires of tin-plated annealed copper wires having a diameter of 0.11 mm in a spiral shape on a periphery of the insulated electric wire 11. The reversal lateral winding layer 40 was formed by laterally winding elemental wires of tin-plated annealed copper wires having a diameter of 0.11 mm in a spiral shape on a periphery of the buffer layer 30. Further, as the buffer layer 30, a PET tape having a thickness of 0.04 mm was used.

Table 1 shows the winding angle θ1, the winding angle θ2 and the absolute value of difference between the winding angle θ1 and the winding angle θ2 of the cables according to Examples and Comparative Examples. Further, in Table 1, the term of "copper braided shield" means a cable used as a reference example for evaluating performance of the cables according to Examples and Comparative Examples. The copper braided shield cable includes the insulated electric wire 11 used for Examples, a copper braided layer formed by braiding elemental wires of tin-plated annealed copper wires having a diameter of 0.11 mm and formed on a periphery of the insulated electric wire 11, and the sheath 50 formed on a periphery of the copper braided layer.

TABLE 1

| | | Lateral winding shield winding angle (degree) | | Difference between lateral winding shield winding angles |
|---|---|---|---|---|
| | Kind of shield | θ1 | θ2 | \|θ1-θ2\|(degree) |
| Reference | Copper braided shield | — | — | — |
| Example 1 | Double lateral winding shield | 45 | 40 | 5 |
| Example 2 | | 45 | 30 | 15 |
| Example 3 | | 45 | 25 | 20 |
| Comparative Example 1 | | 45 | 20 | 25 |
| Comparative Example 2 | | 45 | 15 | 30 |

Evaluation of Shield Performance of Cable

Figure 5:
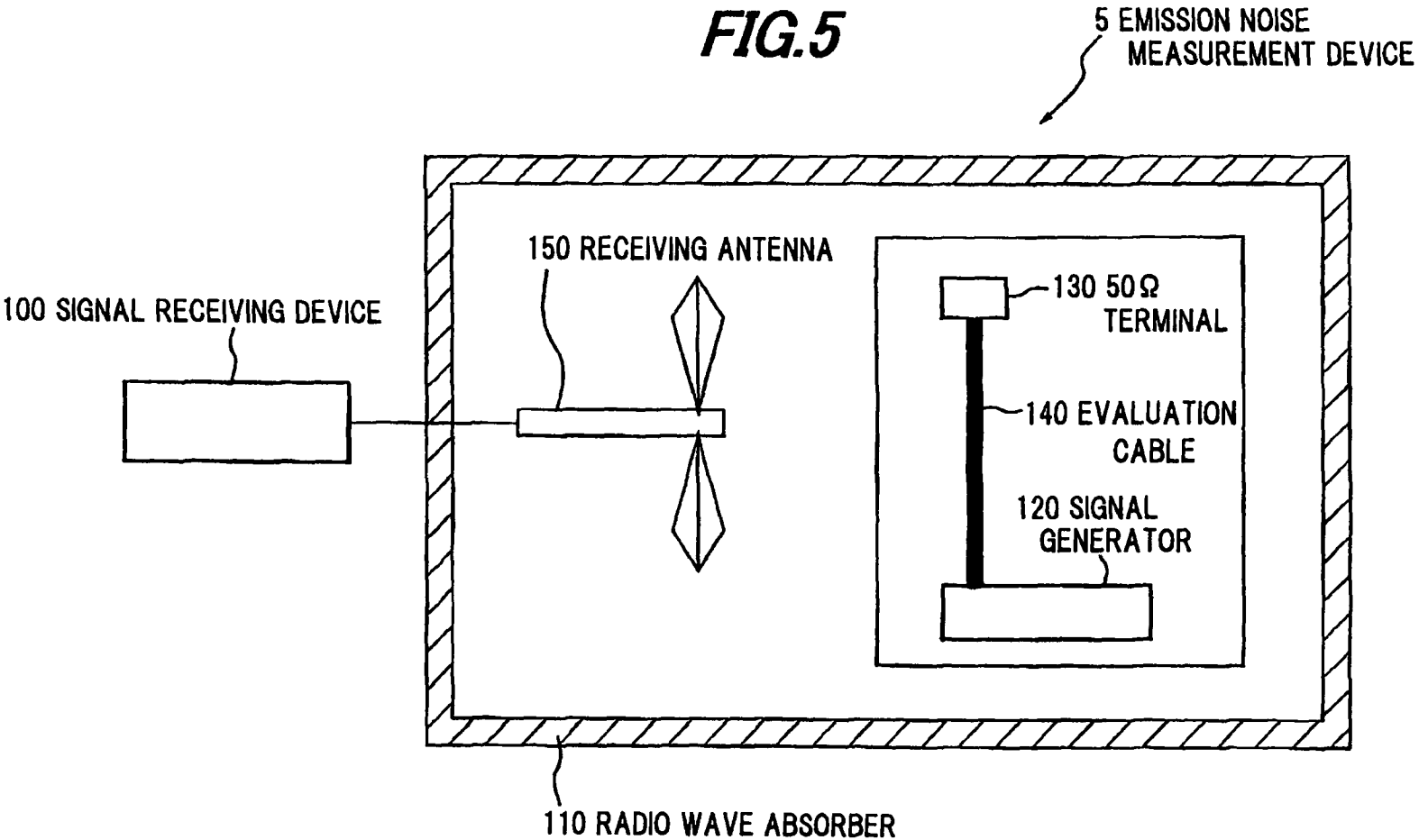
FIG. 5 is an explanatory view schematically showing an emission noise measurement device used for an evaluation of characteristics of cables according to Examples and Comparative Examples.

FIG. 5 is an explanatory view schematically showing an emission noise measurement device used for an evaluation of characteristics of cables according to Examples and Comparative Examples.

An emission noise measurement device 5 includes a signal generator 120 for generating a predetermined signal, an evaluation cable 140 to which the signal generated in the signal generator 120 is supplied, a receiving antenna 150 for receiving an emission noise emitted from the evaluation cable 140, and a signal receiving device 100 for measuring a signal received by the receiving antenna 150. Also, a 50Ω terminal 130 is connected to another end of the evaluation cable 140 opposite to one end thereof connected to the signal generator 120. As the 50Ω terminal 130, a BNC connector of 50Ω was used. Further, the signal generator 120, the evaluation cable 140, the 50Ω terminal 130, and the receiving antenna 150 were housed within a radio wave absorber 110 respectively.

As the evaluation cable 140, the copper braided shield cable as the reference, and the cables according to Examples 1 to 3 and Comparative Examples 1 to 2 were used respectively. Each length of the cables was set to 1 m. An evaluation method of shield performance is as follows. Namely, first, a sine curve signal of −24 dBm was input from the signal generator 120 to each cable. Next, based on the signal input, an electromagnetic wave of 30 MHz to 300 MHz emitted from the cable was received at the receiving antenna 150. Also, the electromagnetic wave received at the receiving antenna 150 was measured by the signal receiving device 100. Due to this, the shield performance of each cable was evaluated.

Further, the measurement method was determined in accordance with CISPR25 (Vehicles, boats and internal combustion engines—Radio disturbance characteristics—Limits and methods of measurement for the protection of on-board receivers). In addition, the term "shield effect" in the specification is defined as follows. First, a level (hereinafter referred to as "reference level") of emission electromagnetic wave of a cable having no shield (the insulated electric wire 11 in FIG. 4) was preliminarily measured. Next, a level (hereinafter referred to as "measurement level") of emission electromagnetic wave of each cable was measured. Next, a value calculated by subtracting "measurement level" from "reference level" was defined as the "shield effect".

Table 2 shows the shield effects of the copper braided shield cable and the cables according to Examples and Comparative Examples respectively. In Table 2, the shield effect was measured at each of 50 MHz, 100 MHz and 250 MHz in order to determine superiority or inferiority.

TABLE 2

| | Difference between lateral winding shield winding angles | Shield effect (dB) | | |
|---|---|---|---|---|
| | \|θ1-θ2\|(degree) | 50 MHz | 100 MHz | 250 MHz |
| Reference | — | 20 | 25 | 24 |
| Example 1 | 5 | 18 | 23 | 22 |
| Example 2 | 15 | 16 | 20 | 18 |
| Example 3 | 20 | 15 | 19 | 18 |
| Comparative Example 1 | 25 | 11 | 14 | 12 |
| Comparative Example 2 | 30 | 5 | 6 | 8 |

Referring to Table 2, it was shown that if the copper braided shield cable is used as a reference, when the value of |θ1−θ2| exceeds 20 degrees, the shield effect is drastically decreased. Namely, it was confirmed that the value of |θ1−θ2| is preferably not more than 20 degrees.

Figure 6:
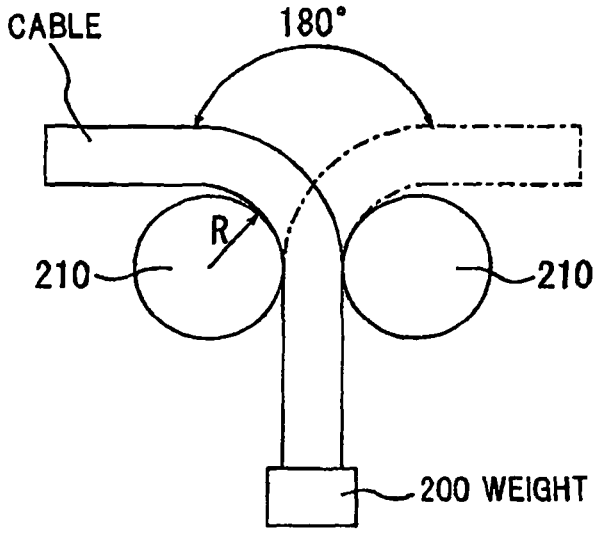
FIG. 6 is an explanatory view schematically showing a method of evaluating bending durability of cables according to Examples and Comparative Examples.

FIG. 6 is an explanatory view schematically showing a method of evaluating bending durability of cables according to Examples and Comparative Examples.

In order to evaluate bending durability of the cables, the cable according to Example 1 was compared with the cable used as a reference. The bending durability was evaluated in accordance with IEC 60227-1 which is an electrical appliance and material engineering standards. Particularly, a weight 200 was installed in each end part of the cable according to Example and the cable used as the reference. Next, the Example cable and the reference cable were respectively sandwiched between two mandrels 210, and the cables were bent more than one time, at the right and left bending angle of 180 degrees whose start points are the sandwiched parts, and at a curvature radius R of 30. One round of the bending was counted as one time thereof In addition, the bending durability was evaluated by determining whether or not breakage of the shield of each cable is present.

TABLE 3

| | Shield | R30 right and left 180 degrees bending durability |
|---|---|---|
| Reference | Copper braided shield | Breakage at 50,000 times |
| Example 1 | Double lateral winding shield | No breakage at 500,000 times or more |

Referring to Table 3, it was shown that the cable according to Example 1 excels in the bending durability not less than ten times in comparison with the conventional copper braided shield cable.

Winding Angle θ1 and Winding Angle θ2

Next, a desired angle of the winding angle θ1 of the elemental wires constituting the lateral winding layer 20 was determined. Particularly, the cables according to Comparative Example 3 and Examples 4 to 6 which have a structure similar to the cable shown in FIG. 4 and have the winding angle of the elemental wires constituting the lateral winding layer 20 shown in Table 4 were fabricated. More particularly; in the cables according to Comparative Example 3 and Examples 4 to 6, the winding angle θ1 of the elemental wires constituting the lateral winding layer 20 was equalized to the winding angle θ2 of the elemental wires constituting the reversal lateral winding layer 40, so as to set a difference between θ1 and θ2 to 0 degree.

TABLE 4

| | Kind of shield | Winding angles θ1, θ2 (degree) (*1) of elementary wires constituting lateral winding layer |
|---|---|---|
| Reference | Copper braided shield | — (twist braid angle is 45 degrees) |
| Comparative Example 3 | Double lateral winding shield | 30 |
| Example 4 | | 40 |
| Example 5 | | 60 |
| Example 6 | | 75 |

Shield effect and bending durability of the cables according to Comparative Example 3 and Examples 4 to 6 were evaluated similarly to the above-mentioned "Evaluation of shield performance of cable". Table 5 shows the evaluation result.

TABLE 5

| | Kind of shield | Winding angles θ1, θ2 (degrees) of elementary wires constituting lateral winding layer | R30 right and left 180 degrees flex life (times) | Shield effect (dB) 50 MHz | 100 MHz | 250 MHz |
|---|---|---|---|---|---|---|
| Reference | Copper braided shield | — (twist braid angle is 45 degrees) | 50,000 | 20 | 25 | 24 |
| Comparative Example 3 | Double lateral winding shield | 30 | 100,000 | 20 | 25 | 24 |
| Example 4 | | 40 | 500,000 | | | |
| Example 5 | | 60 | 700,000 or more | | | |
| Example 6 | | 75 | 700,000 or more | | | |

Referring to Table 5, it was shown that if the winding angle of the elemental wires constituting the lateral winding layer 20 was not less than 40 degrees, a flex life becomes not less than 500, 000 times, so that the bending durability of not less than five times in comparison with a case that the winding angle was 30 degrees (Comparative Example 3) can be performed. Consequently, it is preferable that the winding angle of the elemental wires is not less than 40 degrees. Further, the cables according to Examples 4 to 6 have the buffer layer 30 formed between the lateral winding layer 20 and the reversal lateral winding layer 40, so that when the cable is bent, friction between the elemental wires constituting the lateral winding layer 20 and the elemental wires constituting the reversal lateral winding layer 40 can be prevented. Due to this, breakage of the elemental wires constituting the lateral winding layer 20 and the elemental wires constituting the reversal lateral winding layer 40 can be prevented, so that a cable which is capable of performing extremely excellent bending durability can be provided.

Next, the shield effect was determined by that either or both of the winding angle θ1 of the elemental wires constituting the lateral winding layer 20 and the winding angle θ2 of the elemental wires constituting the reversal lateral winding layer 40 was (are) set to 40 degrees, and simultaneously, a difference between the winding angle θ1 and the winding angle θ2 was variously changed within a range of 5 degrees to 30 degrees. The result is shown in Table 6.

TABLE 6

| | Lateral winding shield winding angle (degrees) θ1 | θ2 | Difference between lateral winding shield winding angles \|θ1 − θ2\|(degrees) | Shield effect (dB) 50 MHz | 100 MHz | 250 MHz |
|---|---|---|---|---|---|---|
| Reference | — | — | — | 20 | 25 | 24 |
| Example 7 | 60 | 55 | 5 | 18 | 23 | 22 |
| Example 8 | 60 | 45 | 15 | 16 | 20 | 18 |
| Example 9 | 60 | 40 | 20 | 15 | 19 | 18 |
| Comparative Example 4 | 60 | 35 | 25 | 11 | 14 | 12 |
| Comparative Example 5 | 60 | 30 | 30 | 5 | 6 | 8 |

Referring to Table 6, it was shown that if the copper braided shield cable is used as a reference, when the value of |θ1−θ2| exceeds 20 degrees, the shield effect is drastically decreased. Namely, it was shown that it is preferable that the value of |θ1−θ2| is not more than 20 degrees. From the above, it was shown that it is preferable that both of the winding angle θ1 and the winding angle θ2 are not less than 40 degrees and simultaneously, the value of |θ1−θ2| is not more than 20 degrees.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A cable, comprising:

an insulated electric wire;

a lateral winding layer formed by spirally winding an elemental wire having conductivity on a periphery of the insulated electric wire;

a reversal lateral winding layer formed by spirally winding an elemental wire having conductivity in a direction intersecting with a winding direction of the lateral winding layer;

a buffer layer formed between the lateral winding layer and the reversal lateral winding layer; and a sheath formed on a periphery of the reversal lateral winding layer, wherein a winding angle θ1 to an axial direction of the insulated electric wire of the elemental wire forming the lateral winding layer and a winding angle θ2 to an axial direction of the insulated electric wire of the elemental wire forming the reversal lateral winding layer are each an acute angle, wherein the winding angle θ1 or the winding angle θ2 is not less than 40 degrees, wherein an absolute value of a difference between the winding angle θ1 and the winding angle θ2 is not more than 20 degrees, and wherein the elemental wire forming the lateral winding layer and the elemental wire forming the reversal lateral winding layer are circular in cross section, respectively.

2. The cable according to claim 1, further comprising:

a second buffer layer formed between the reversal lateral winding layer and the sheath.

3. The cable according to claim 2, further comprising:

a reinforcing braided layer formed by alternately weaving a plurality of fibers together.

4. The cable according to claim 3, wherein the buffer layer and the second buffer layer comprise a resin tape, a paper tape or a resin layer by an extrusion coating.

5. The cable according to claim 3, wherein at least one of the buffer layer and the second buffer layer comprises a laminated structure that includes at least one selected from the group consisting of a resin tape, a paper tape, and a resin layer by an extrusion coating.

6. The cable according to claim 4, wherein the insulated electric wire comprises a plurality of insulated electric wires, a holding winding provided on peripheries of the plurality of insulated electric wires, and an interposition filled between the holding winding and the plurality of insulated electric wires.

7. The cable according to claim 1, wherein each of the winding angle θ1 and the winding angle θ2 is at least 40 degrees.

8. The cable according to claim 1, further comprising:

a second buffer layer extending from an outer surface of the reversal lateral winding layer to an inner surface of the sheath.

9. The cable according to claim 8, wherein the second buffer layer comprises one of a resin tape, a paper tape, and a resin layer that continuously extends from the outer surface of the reversal lateral winding layer to the inner surface of the sheath.

* * * * *